US007164401B2

(12) United States Patent
Kwon

(10) Patent No.: US 7,164,401 B2
(45) Date of Patent: Jan. 16, 2007

(54) LIGHT EMITTING DISPLAY, DISPLAY PANEL, AND DRIVING METHOD THEREOF

(75) Inventor: Oh-Kyong Kwon, Seoul (KR)

(73) Assignee: Samsung SDI Co., Ltd, Suwon (KR)

( * ) Notice: Subject to any disclaimer, the term of this patent is extended or adjusted under 35 U.S.C. 154(b) by 576 days.

(21) Appl. No.: 10/729,505

(22) Filed: Dec. 4, 2003

(65) Prior Publication Data

US 2004/0196224 A1 Oct. 7, 2004

(30) Foreign Application Priority Data

Apr. 1, 2003 (KR) ..... 10-2003-0020434

(51) Int. Cl.
*G09G 3/32* (2006.01)

(52) U.S. Cl. ..... 345/82

(58) Field of Classification Search ..... 345/76–82, 345/204, 211; 315/169.1, 169.3, 169.4
See application file for complete search history.

(56) References Cited

U.S. PATENT DOCUMENTS

| | | | | |
|---|---|---|---|---|
| 5,952,789 | A * | 9/1999 | Stewart et al. | 315/169.4 |
| 6,229,506 | B1 * | 5/2001 | Dawson et al. | 345/82 |
| 6,501,466 | B1 * | 12/2002 | Yamagishi et al. | 345/204 |
| 6,580,408 | B1 * | 6/2003 | Bae et al. | 345/76 |
| 6,670,773 | B1 * | 12/2003 | Nakamura et al. | 315/169.3 |
| 6,686,699 | B1 * | 2/2004 | Yumoto | 315/169.3 |
| 6,693,388 | B1 * | 2/2004 | Oomura | 315/169.3 |
| 6,724,151 | B1 * | 4/2004 | Yoo | 315/169.3 |
| 6,750,833 | B1 * | 6/2004 | Kasai | 345/76 |
| 6,806,857 | B1 * | 10/2004 | Sempel et al. | 345/92 |
| 6,847,171 | B1 * | 1/2005 | Tam | 315/169.3 |
| 7,019,717 | B1 * | 3/2006 | Yumoto et al. | 345/76 |
| 2002/0195964 | A1 | 12/2002 | Yumoto | |

OTHER PUBLICATIONS

A. Yumoto et al; "Pixel-Driving Methods for Large-Sized Poly-Si AM-OLED Displays"; Asia Display/IDW '01, Proceedings of the 21st International Display Research Conference in Conjunction with the 8th International Display Workshops, Nagoya, JApan, Oct. 16, 2001, vol. 21/8, pp. 1395-1398.

Y. He et al, "Current-Source a-Si:H Thin -Film Transistor Circuit for Active-Matrix Organic Light-Emitting Displays"; IEEE Electron Device Letters, vol. 21, No. 12, Dec. 2000, pp. 590-592.

S.K. Bhowmick et al, P-100: An Improved Four TFT Circuit for Active-Matrix Organic Light Emitting Diode (OLED) Display; SID International Symposium Digest of Technical Papers, May 21, 2002, pp. 606-609.

* cited by examiner

*Primary Examiner*—Richard Hjerpe
*Assistant Examiner*—Kimnhung Nguyen
(74) *Attorney, Agent, or Firm*—Christie, Parker & Hale LLP

(57) ABSTRACT

A light emitting display. A first capacitor is coupled between a gate of a first transistor and a power supply voltage. The gate thereof is coupled to a gate of a second transistor, and a data current from a data line is transmitted to the second transistor to set the gate voltages of the first and second transistors as a first voltage. A second capacitor is formed between the gates of the first and second transistors, and the data current from the data line is intercepted. Here, the first capacitor stores a second voltage by coupling of the first and second capacitors. A driving current output from the first transistor is transmitted to a light emitting element, corresponding to the second voltage.

21 Claims, 5 Drawing Sheets

LIGHT EMITTING DISPLAY, DISPLAY PANEL, AND DRIVING METHOD THEREOF

CROSS REFERENCE TO RELATED APPLICATION

This application claims priority to and the benefit of Korea Patent Application No. 2003-20434 filed on Apr. 1, 2003 in the Korean Intellectual Property Office, the content of which is incorporated herein by reference.

BACKGROUND OF THE INVENTION (a) Field of the Invention

The present invention relates to a light emitting display, a display panel, and a driving method thereof. More specifically, the present invention relates to an organic electroluminescent (EL) display.

(b) Description of the Related Art

In general, an organic EL display electrically excites a phosphorous organic compound to emit light, and it voltage- or current-drives N×M organic emitting cells to display images. As shown in FIG. 1, an organic emitting cell includes an anode of indium tin oxide (ITO), an organic thin film, and a cathode layer of metal. The organic thin film has a multi-layer structure including an emitting layer (EML), an electron transport layer (ETL), and a hole transport layer (HTL) for maintaining balance between electrons and holes and improving emitting efficiencies, and it further includes an electron injecting layer (EIL) and a hole injecting layer (HIL).

Methods for driving the organic emitting cells include the passive matrix method, and the active matrix method using thin film transistors (TFTs) or metal oxide semiconductor field effect transistors (MOSFETs). The passive matrix method forms cathodes and anodes to cross with each other, and selectively drives lines. The active matrix method connects a TFT and a capacitor with each ITO pixel electrode to thereby maintain a predetermined voltage according to capacitance. The active matrix method is classified as a voltage programming method or a current programming method according to signal forms supplied for maintaining a voltage at a capacitor.

Referring to FIGS. 2 and 3, conventional organic EL displays of the voltage programming and current programming methods will be described.

FIG. 2 shows a conventional voltage programming type pixel circuit for driving an organic EL element, representing one of N×M pixels. Referring to FIG. 2, transistor M1 is coupled to an organic EL element (referred to as an OLED hereinafter) to thus supply current for light emission. The current of transistor M1 is controlled by a data voltage applied through switching transistor M2. In this instance, capacitor C1 for maintaining the applied voltage for a predetermined period is coupled between a source and a gate of transistor M1. Scan line $S_n$ is coupled to a gate of transistor M2, and data line Dm is coupled to a source thereof.

As to an operation of the above-configured pixel, when transistor M2 is turned on according to a select signal applied to the gate of switching transistor M2, a data voltage from data line Dm is applied to the gate of the transistor M1. Accordingly, current $I_{OLED}$ flows to transistor M2 in correspondence to a voltage $V_{GS}$ charged between the gate and the source by C1, and the OLED emits light in correspondence to current $I_{OLED}$.

In this instance, the current that flows to the OLED is given in Equation 1.

$$I_{OLED} = \frac{\beta}{2}(V_{GS} - V_{TH})^2 = \frac{\beta}{2}(V_{DD} - V_{DATA} - |V_{TH}|)^2 \quad \text{Equation 1}$$

where $I_{OLED}$ is the current flowing to the OLED, $V_{GS}$ is a voltage between the source and the gate of the transistor M1, $V_{TH}$ is a threshold voltage at transistor M1, and β is a constant.

As given in Equation 1, the current corresponding to the applied data voltage is supplied to the OLED, and the OLED gives light in correspondence to the supplied current, according to the pixel circuit of FIG. 2. In this instance, the applied data voltage has multi-stage values within a predetermined range so as to represent gray.

However, the conventional pixel circuit following the voltage programming method has a problem in that it is difficult to obtain high gray because of deviation of a threshold voltage $V_{TH}$ of a TFT and deviations of electron mobility caused by non-uniformity of an assembly process. For example, in the case of driving a TFT of a pixel with 3 volts (3V), voltages are to be supplied to the gate of the TFT for each interval of 12 mV (=3V/256) so as to represent 8-bit (256) grays, and if the threshold voltage of the TFT caused by the non-uniformity of the assembly process deviates, it is difficult to represent high gray. Also, since the value β in Equation 1 changes because of the deviations of the electron mobility, it becomes even more difficult to represent the high gray.

On assuming that the current source for supplying the current to the pixel circuit is uniform over the whole panel, the pixel circuit of the current programming method can achieve uniform display features even though a driving transistor in each pixel has non-uniform voltage-current characteristics.

FIG. 3 shows a pixel circuit of a conventional current programming method for driving the OLED, representing one of N×M pixels. Referring to FIG. 3, transistor M1 is coupled to the OLED to supply the current for light emission, and the current of transistor M1 is controlled by the data current applied through transistor M2.

First, when transistors M2 and M3 are turned on because of the select signal from scan line $S_n$, transistor M1 becomes diode-connected, and the voltage matched with data current $I_{DATA}$ from data line Dm is stored in capacitor C1. Next, the select signal from scan line $S_n$ becomes high-level to turn on transistor M4. Then, the power is supplied from power supply voltage VDD, and the current matched with the voltage stored in capacitor C1 flows to the OLED to emit light. In this instance, the current flowing to the OLED is as follows.

$$I_{OLED} = \frac{\beta}{2}(V_{GS} - V_{TH})^2 = I_{DATA} \quad \text{Equation 2}$$

where $V_{GS}$ is a voltage between the source and the gate of transistor M1, $V_{TH}$ is a threshold voltage at transistor M1, and β is a constant.

As given in Equation 2, since current $I_{OLED}$ flowing to the OLED is the same as data current $I_{DATA}$ in the conventional current pixel circuit, uniform characteristics can be obtained when the programming current source is set to be uniform over the whole panel. However, since current $I_{OLED}$ flowing to the OLED is a fine current, control over the pixel circuit by fine current $I_{DATA}$ problematically requires much time to charge the data line. For example, assuming that the load capacitance of the data line is 30 pF, it requires several milliseconds of time to charge the load of the data line with the data current of several tens to hundreds of nA. This causes a problem that the charging time is not sufficient in consideration of the line time of several tens of microseconds.

SUMMARY OF THE INVENTION

In accordance with the present invention a light emitting display is provided for compensating for the threshold voltage of transistors or for electron mobility, and sufficiently charging the data line.

In one aspect of the present invention, a light emitting display is provided on which a plurality of data lines for transmitting data current that displays video signals, a plurality of scan lines for transmitting a select signal, and a plurality of pixel circuits formed at a plurality of pixels defined by the data lines and the scan lines are formed. The pixel circuit includes: a light emitting element for emitting light corresponding to the applied current; a first transistor, having first and second main electrodes and a control electrode, for supplying a driving current for the light emitting element a second transistor being diode-connected; a first switch for transmitting a data current from the data line to the second transistor in response to a select signal from the scan line; a first storage element having a first end coupled to the first main electrode of the first transistor and a first main electrode of the second transistor, and a second end thereof coupled to the control electrode of the first transistor, the second end being coupled to a gate of the second transistor in response to a first level of a first control signal; a second storage element coupled between the second end of the first storage element and a control electrode of the second transistor in response to a second level of the first control signal; and a second switch for coupling the first transistor and the light emitting element in response to a second control signal. The light emitting display operates in the order of a first interval for selecting the first level of the first control signal and the select signal, a second interval for selecting the second level of the first control signal, and a third interval for selecting the second control signal. The voltage of the control electrode of the second transistor is determined as a first voltage in correspondence with the data current in the first interval. A control electrode voltage of the second transistor is changed to a second voltage from the first voltage by the interception of the data current. A control electrode voltage of the first transistor is determined as a third voltage by coupling of the first and second storage elements to store a fourth voltage in the first storage element in the second interval. A driving current corresponding to the fourth voltage is transmitted to the light emitting element from the first transistor in the third interval. The pixel circuit further includes a third switch coupled between the control electrodes of the first and second transistors. The third switch is turned on by the first level of the first control signal. The first control signal is the select signal. The first control signal is supplied from an additional signal line other than the scan line, and the first control signal has faster timing than the select signal. A channel width of the first transistor is equal to or shorter than the channel width of the second transistor. A channel length of the first transistor is equal to or longer than the channel width of the second transistor. The first storage element is a first capacitor formed between the first main electrode and the control electrode of the first transistor. The second storage element is a second capacitor formed between the control electrodes of the first and second transistors. Capacitance of the first capacitor and capacitance of the second capacitor is determined by one of a screen size and resolution. Uniformity between the threshold voltages of the first and second transistors is high.

In another aspect of the present invention, a method is provided for driving a light emitting display having a pixel circuit including a first switch for transmitting a data current from a data line in response to a select signal from a scan line, a first transistor including first and second main electrodes and a control electrode for outputting a driving current corresponding to the data current, a first storage element formed between the first main electrode and the control electrode of the first transistor, and a light emitting element for emitting light corresponding to the driving current from the first transistor. The control electrode of the diode-connected second transistor is coupled to the control electrode of the first transistor. The data current is transmitted from the first switch to the second transistor to establish the control electrode voltage of the second transistor as a first voltage. A second storage element is formed between the control electrodes of the first and second transistors. Data current is intercepted to modify the first voltage into a second voltage to which a threshold voltage of the second transistor is reflected. Coupling of the second voltage and the first and second storage elements is used to modify the control electrode voltage of the first transistor into a third voltage from the first voltage. A driving current output is transmitted by the first transistor to the light emitting element corresponding to the third voltage.

In still another aspect of the present invention, a display panel of a light emitting display is provided, on which are formed a plurality of data lines for transmitting the data current that displays video signals, a plurality of scan lines for transmitting a select signal, and a plurality of pixel circuits formed at a plurality of pixels defined by the data lines and the scan lines. The pixel circuit includes: a light emitting element for emitting light corresponding to the applied current; a first transistor having first and second main electrodes and a control electrode, for supplying a driving current for emitting light from the light emitting element; a second transistor being diode-connected; a first switch for transmitting a data current from the data line to the second transistor in response to a select signal from the scan line; a first storage element coupled to the control electrode of the first transistor; and a second storage element. The display panel operates in the order of: a first interval for coupling control electrodes of the first and second transistors, and storing voltage in the first storage element corresponding to a data current from the first switch; a second interval for forming a second storage element between the control electrodes of the first and second transistors, and intercepting the data current to divide a voltage corresponding to a threshold voltage of the second transistor into the first and second storage elements; and a third interval for transmitting a driving current output by the first transistor to the light emitting element corresponding to the voltage stored in the first storage element. The control electrodes of the first and second transistors are coupled in response to a first-level first control signal. The data current is transmitted to the second transistor in response to the select signal in the first interval. The second storage element is coupled between the control electrodes of the first and second transistors in response to a second-level first control signal. The select signal becomes a disable level to intercept the data current in the second interval. The driving current is transmitted to the light emitting element in response to a second control signal in the third interval.

DETAILED DESCRIPTION

An organic EL display, a corresponding pixel circuit, and a driving method thereof will be described in detail with reference to drawings.

Figure 1:
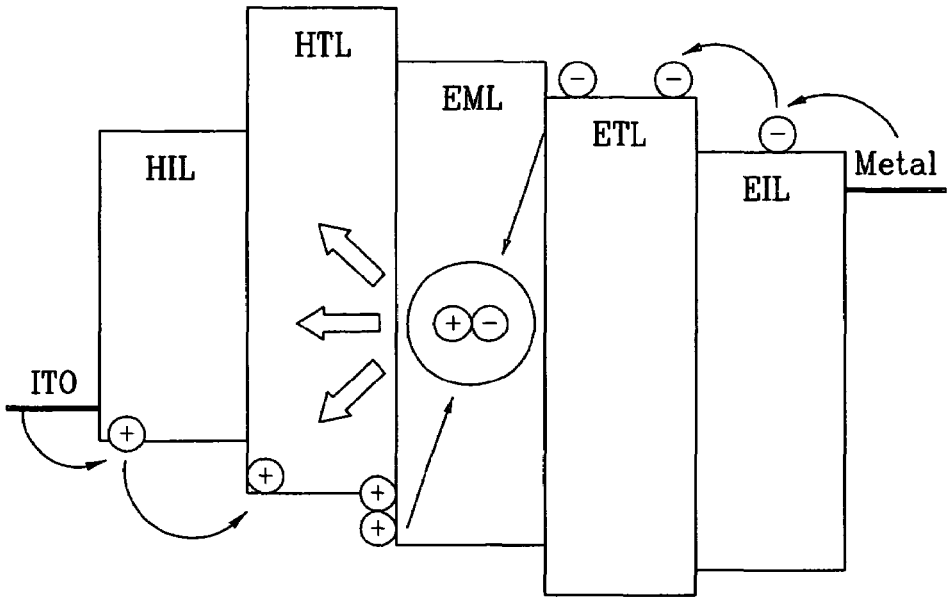
FIG. 1 shows a concept diagram of an OLED.
Figure 2:
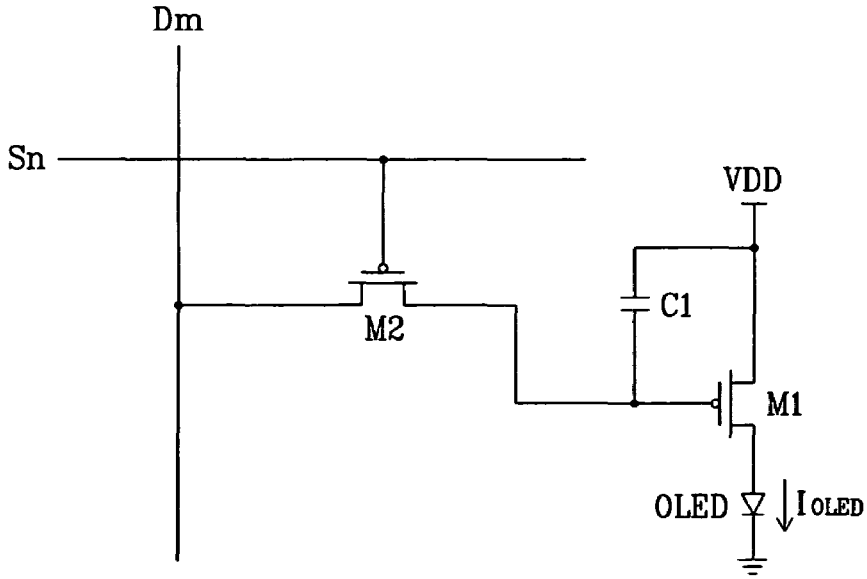
FIG. 2 shows an equivalent circuit of a conventional pixel circuit following the voltage programming method.
Figure 3:
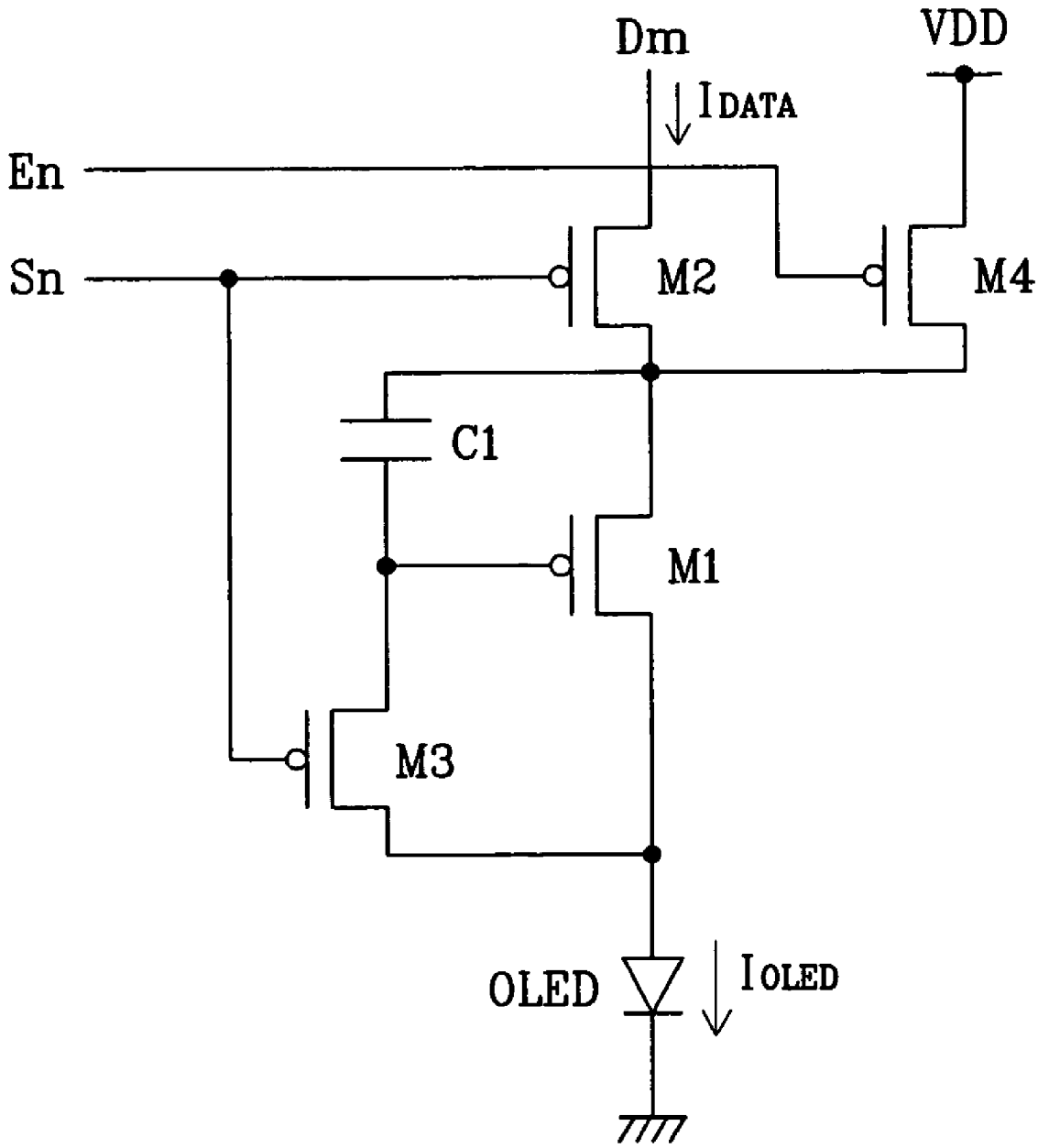
FIG. 3 shows an equivalent circuit of a conventional pixel circuit following the current programming method.
Figure 4:
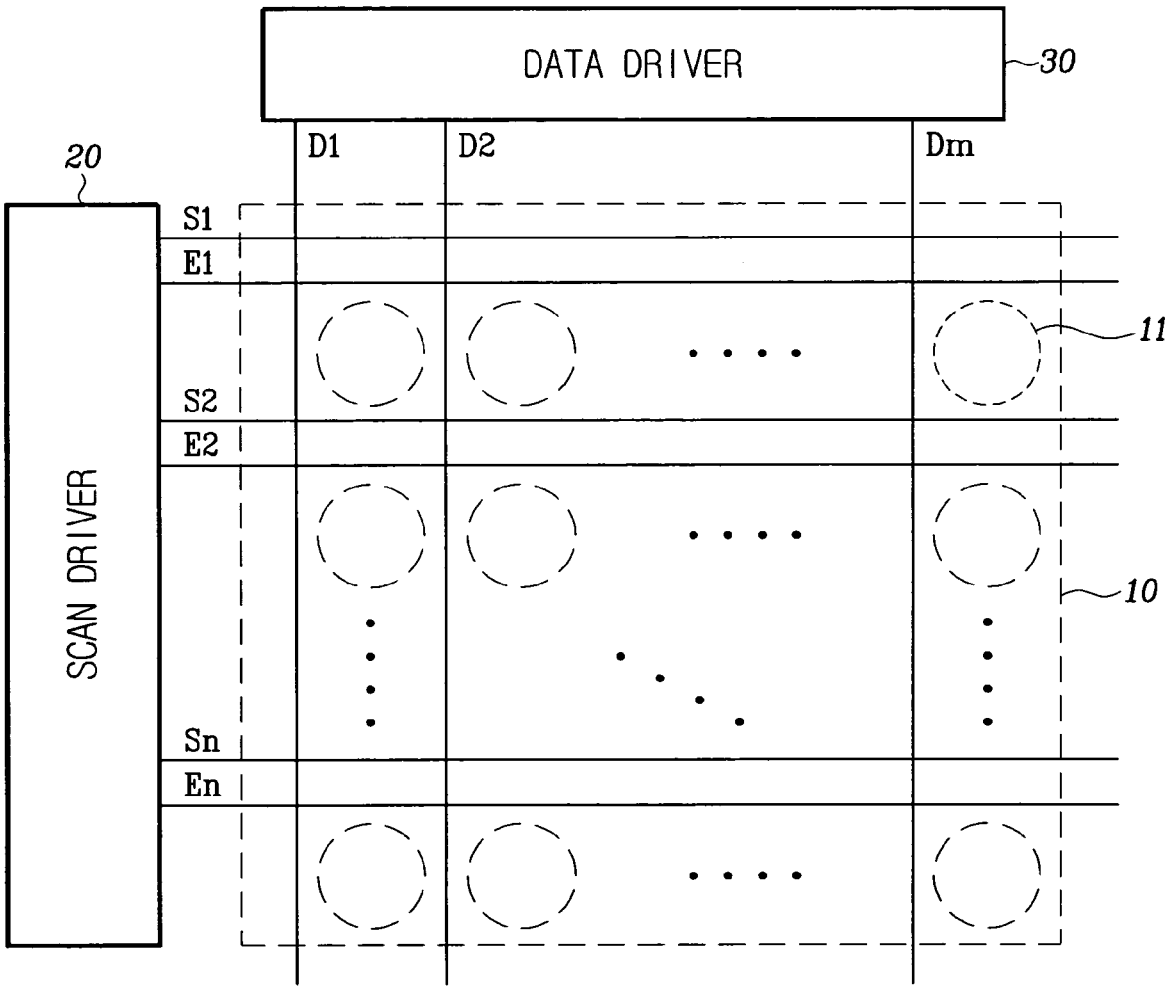
FIG. 4 shows a brief plane diagram of an organic EL display according to an embodiment of the present invention.

First, referring to FIG. 4, the organic EL display will be described. FIG. 4 shows a brief ground plan of the OLED.

As shown, the organic EL display includes organic EL display panel 10, scan driver 20, and data driver 30.

Organic EL display panel 10 includes a plurality of data lines $D_1$ through $D_m$ in the row direction, a plurality of scan lines $S_1$ through $S_n$ and $E_1$ through $E_n$, and a plurality of pixel circuits 11. Data lines $D_1$ through $D_m$ transmit data signals that represent video signals to pixel circuit 11, and scan lines $S_1$ through $S_n$ transmit select signals to pixel circuit 11. Pixel circuit 11 is formed at a pixel region defined by two adjacent data lines $D_1$ through $D_m$ and two adjacent scan lines $S_1$ through $S_n$. Also, scan lines $E_1$ through $E_n$ transmit emit signals for controlling emission of the pixel circuits 11.

Scan driver 20 sequentially applies respective select signals and emit signals to the scan lines $S_1$ through $S_n$ and $E_1$ through $E_n$. Data driver 30 applies the data current that represents video signals to the data lines $D_1$ through $D_m$.

Scan driver 20 and/or data driver 30 can be coupled to display panel 10, or can be installed, in a chip format, in a tape carrier package (TCP) coupled to display panel 10. The same can be attached to display panel 10, and installed, in a chip format, on a flexible printed circuit (FPC) or a film coupled to the display panel 10, which is referred to as a chip on flexible board, or chip on film (CoF) method. Differing from this, scan driver 20 and/or data driver 30 can be installed on the glass substrate of the display panel, and further, the same can be substituted for the driving circuit formed in the same layers of the scan lines, the data lines, and TFTs on the glass substrate, or directly installed on the glass substrate, which is referred to as a chip on glass (CoG) method.

Figure 5:
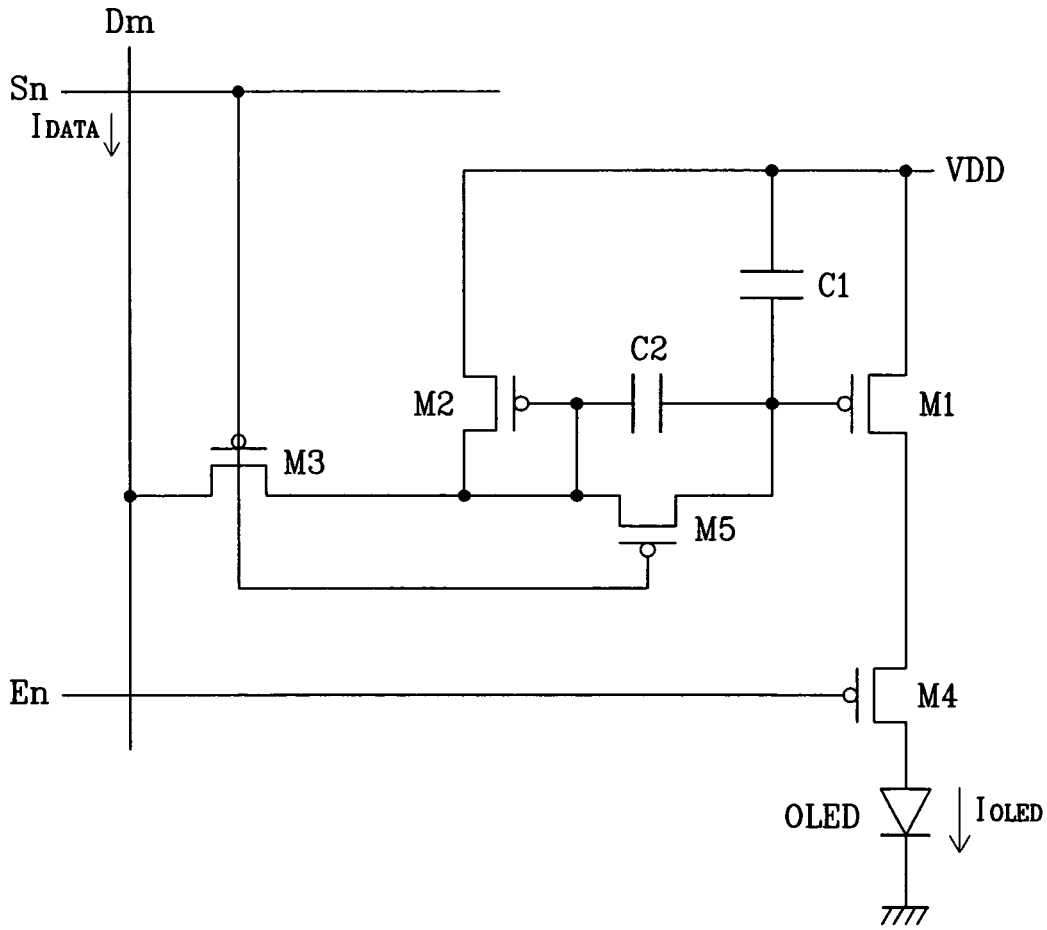
FIGS. 5 and 7 respectively show an equivalent circuit of a pixel circuit according to first and second embodiments of the present invention.
Figure 6:
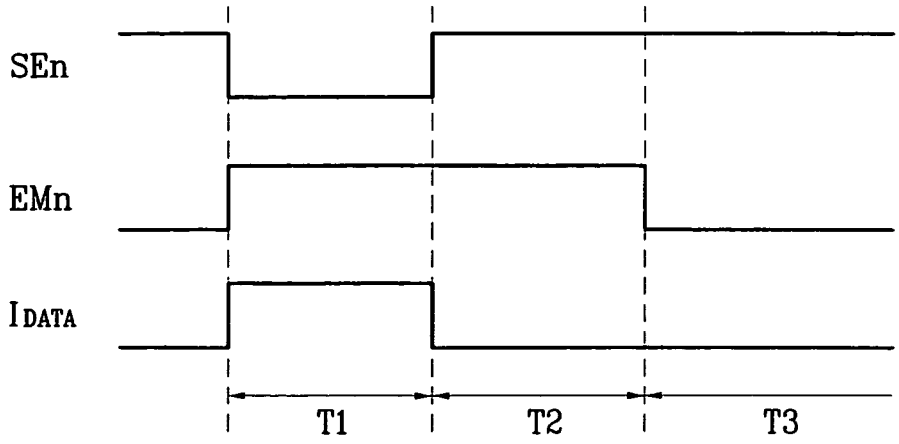
FIGS. 6 and 8 respectively show a driving waveform for driving the pixel circuit of FIGS. 5 and 7.

Referring to FIGS. 5 and 6, pixel circuit 11 of the organic EL display according to the first embodiment of the present invention will now be described. FIG. 5 shows an equivalent circuit diagram of the pixel circuit according to the first embodiment, and FIG. 6 shows a driving waveform diagram for driving the pixel circuit of FIG. 5. In this instance, for ease of description, FIG. 5 shows a pixel circuit coupled to an m-th data line $D_m$ and an n-th scan line $S_n$.

As shown in FIG. 5, pixel circuit 11 includes an OLED, PMOS transistors M1 through M5, and capacitors C1 and C2. The transistor is preferably a transistor having a gate electrode, a drain electrode, and a source electrode formed on the glass substrate as a control electrode and two main electrodes.

Transistor M1 has a source coupled to power supply voltage VDD, and a gate coupled to capacitor C2, and capacitor C1 is coupled between the gate and the source of transistor M1. A gate and a drain of transistor M2 are coupled, that is, diode-connected, and a source of transistor M2 is coupled to power supply voltage VDD. Transistor M5 and capacitor C2 are coupled in parallel between the gate of transistor M2 and the gate of transistor M1.

Transistor M3 transmits data current $I_{DATA}$ from data line $D_m$ to transistor M2 in response to select signal $SE_n$ from scan line $S_n$. Transistor M5 couples the gate of transistor M2 to the gate of transistor M1 in response to select signal $SE_n$ from scan line $S_n$. Transistor M4 is coupled between the drain of transistor M1 and the OLED, and transmits current $I_{OLED}$ of transistor M1 to the OLED in response to emit signal $EM_n$ from scan line $E_n$. The OLED is coupled between transistor M4 and the reference voltage, and emits light corresponding to applied $I_{OLED}$.

Next, referring to FIG. 6, an operation of the pixel circuit according to the first embodiment of the present invention will be described in detail.

As shown, in interval T1, transistor M5 is turned on by low-level select signal $SE_n$ to couple the gate of transistor M1 and the gate of transistor M2. Transistor M3 is turned on by select signal $SE_n$ to have data current $I_{DATA}$ from data line $D_m$ flow to transistor M2. Data current $I_{DATA}$ can be given as Equation 3, and the gate voltage $V_{G3}$(T1) at transistor M2 in interval T1 is determined from Equation 3. Since the gate of transistor M1 and the gate of transistor M2 are coupled, the gate voltage $V_{G1}$(T1) at transistor M1 corresponds to the gate voltage $V_{G3}$(T1) at transistor M2.

$$I_{DATA} = \frac{1}{2}\mu_2 C_{ox2}\frac{W_2}{L_2}(V_{GS} - V_{TH2})^2 = \frac{1}{2}\mu_2 C_{ox2}\frac{W_2}{L_2}(V_{DD} - V_{G2}(T1) - |V_{TH2}|) \quad \text{Equation 3}$$

where $\mu_2$ is electron mobility, $C_{ox2}$ is oxide capacitance, $W_2$ is a channel width, $L_2$ is a channel length, $V_{TH2}$ is a threshold voltage of transistor M2, and $V_{DD}$ is a voltage supplied to transistor M2 by power supply voltage VDD.

In interval T2, select signal $SE_n$ becomes high-level to turn off transistors M3 and M5. Data current $I_{DATA}$ is intercepted by turned-off transistor M3, and since transistor M2 is diode-connected, the gate voltage $V_{G2}$(T2) of transistor M2 becomes $V_{DD}-|V_{TH2}|$. Therefore, the variation $\Delta V_{G2}$ of the gate voltage of transistor M2 between intervals T1 and T2 is given as Equation 4. Since the gate voltage $V_{G1}$(T2) of transistor M1 corresponds to a node voltage of capacitors C1 and C2 coupled in series, the variation $\Delta V_{G1}$ of the gate voltage of transistor M1 is given as Equation 5. That is, the gate voltage $V_{G1}$(T2) of transistor M1 becomes $V_{G1}$(T1)+$\Delta V_{G1}$.

$$\Delta V_{G2} V_{G2}(T2) - V_{G2}(T1) = V_{DD} - |V_{TH2} - |V_{G2}(T1) \quad \text{Equation 4.}$$

$$\Delta V_{G1} = \frac{C_1}{C_1 + C_2}\Delta V_{G2} = \frac{C_1}{C_1 + C_2}(V_{DD} - |V_{TH2}| - V_{G2}(T1)) \quad \text{Equation 5}$$

where $C_1$ and $C_2$ are capacitances of capacitors C1 and C2.

In interval T3, transistor M4 is turned on in response to low-level emit signal $EM_n$. Current $I_{OLED}$ flowing to transistor M1 flows to the OLED by turned-on transistor M4 to emit light, and current $I_{OLED}$ in this instance is given as Equation 6.

$$\begin{aligned} I_{OLED} &= \frac{1}{2}\mu_1 C_{ox1}\frac{W_1}{L_1}(V_{DD} - V_{G1}(T2) - |V_{TH1}|)^2 \\ &= \frac{1}{2}\mu_1 C_{ox1}\frac{W_1}{L_1}\{V_{DD} - \frac{C_1}{C_1 + C_2}(V_{DD} - |V_{TH2}| - \\ &\quad V_{G2}(T1)) - V_{G2}(T1) - |V_{TH1}|\}^2 \end{aligned} \quad \text{Equation 6}$$

where $\mu_1$ is electron mobility, $C_{ox1}$ is oxide capacitance, $W_1$ is a channel width, $L_1$ is a channel length, and $V_{TH1}$ is a threshold voltage of transistor M1.

Since transistors M1 and M2 are adjacently formed in a small pixel, uniformity between the electron mobility $\mu_1$ and $\mu_2$, the threshold voltages $V_{TH1}$ and $V_{TH2}$, and the oxide capacitances $C_{ox1}$ and $C_{ox2}$ improves, and hence they are substantially identical with each other (i.e., $\mu_1=\mu_2$, $V_{TH1=VTH2}$, and $C_{ox1}=C_{ox2}$). Therefore, Equation 6 can also be expressed as Equation 7, and Equation 7 can be given as Equation 8 using Equation 3.

$$I_{OLED} = \frac{1}{2}\mu_1 C_{ox1}\frac{W_1}{L_1}\cdot\frac{C_2}{C_1 + C_2}(V_{DD} - V_{G2}(T1) - |V_{TH2}|)^2 \quad \text{Equation 7}$$

$$I_{OLED} = \frac{W_1}{L_1}\cdot\frac{L_2}{W_2}\left(\frac{C_2}{C_1 + C_2}\right)I_{DATA} \quad \text{Equation 8}$$

In this instance, if the capacitance $C_1$ of capacitor C1 is n times the capacitance $C_2$ of capacitor C2 (i.e., $C_1$=n $C_2$), and the ratio $W_{2b}/L_2$ of the channel width and the channel length of transistor M2 is M times the ratio $W_1/L_1$ of the channel width and the channel length of transistor M1, Equation 8 is given as Equation 9. In particular, it is preferable that the channel width $W_2$ of transistor M2 is equal to or longer than the channel width $W_1$ of transistor M1, and the channel length $L_2$ of transistor M2 is equal to or shorter than the channel length $L_1$ of transistor M1. It is also preferable to optimize the ratio of the capacitance $C_1$ of capacitor C1 and the capacitance $C_2$ of capacitor C2 according to the size and resolution of a screen.

$$I_{OLED} = \frac{1}{M(n+1)}I_{DATA} \quad \text{Equation 9}$$

As given in Equation 9, since current $I_{OLED}$ supplied to the OLED is determined with no relation to the threshold voltage $V_{TH1}$ or the electron mobility $\mu_1$ of transistor M1, the deviation of the threshold voltage or the mobility can be corrected. Also, since current $I_{OLED}$ is controlled by current $I_{DATA}$ which is M(n+1) times greater than current $I_{OLED}$ supplied to the OLED, high gray can be represented. Further, since large data current $I_{DATA}$ is supplied to data lines $D_1$ through $D_m$, the time for charging the data lines can be sufficiently obtained, and a wide OLED can be realized. In addition, since transistors M1 through M5 are the same type, the process for forming the TFTs on the glass substrate can be easily executed.

In the first embodiment, PMOS transistors are used to realize transistors M1 through M5, and NMOS transistors can also be applied. In the case of realizing transistors M1 through M5 through the PMOS transistors, the sources of transistors M1 and M2 are coupled not to power supply voltage VDD but to the reference voltage, a cathode of the OLED is coupled to transistor M4, and an anode thereof is coupled to power supply voltage VDD in the pixel circuit of FIG. 5. The waveforms of select signal $SE_n$ and emit signal $EM_n$ have inverted formats of those in FIG. 6. Since realization of transistors M1 through M5 using the NMOS transistors can be easily known from the description according to the first embodiment, no further description will be provided. Also, transistors M1 through M5 can be realized by combination of PMOS and NMOS transistors or switches having similar functions.

In the first embodiment, transistor M5 is controlled using select signal $SE_n$ from scan line $S_n$, but it can be controlled using a control signal from an additional scan line, which will now be described referring to FIGS. 7 and 8.

Figure 7:
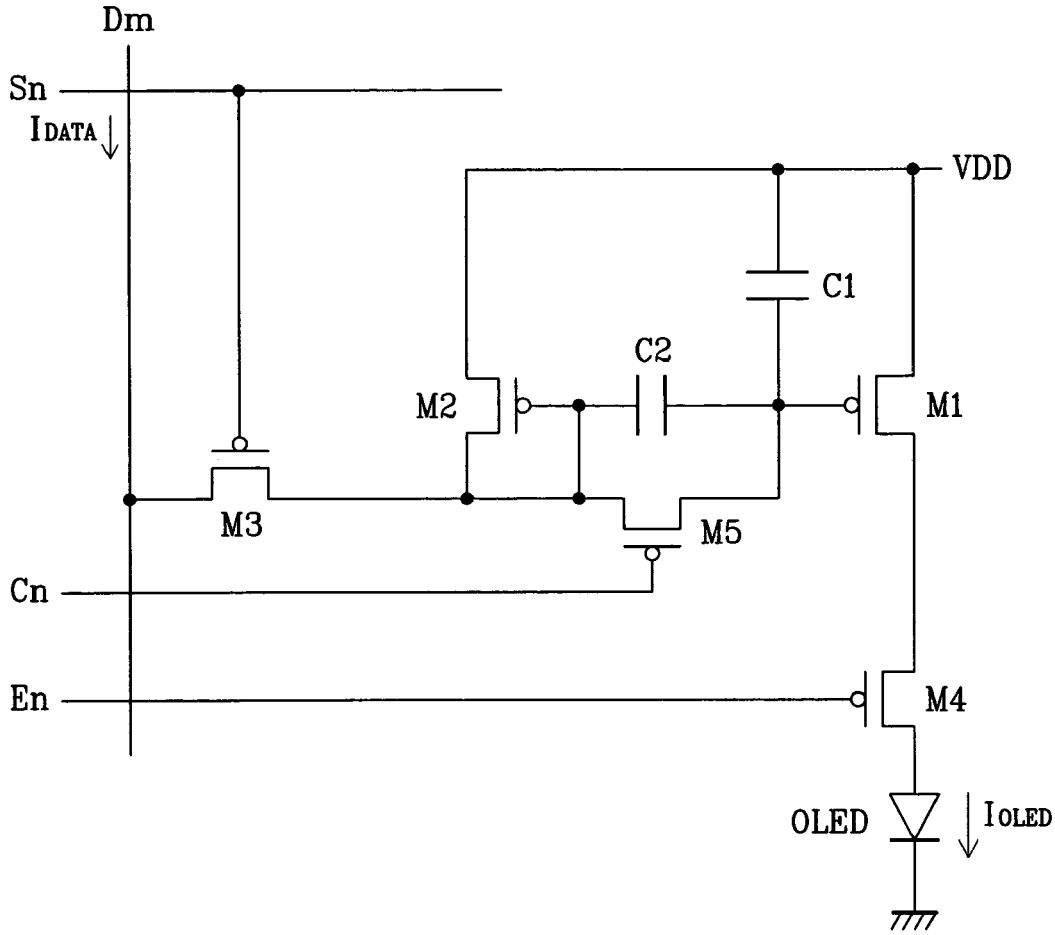
Figure 8:
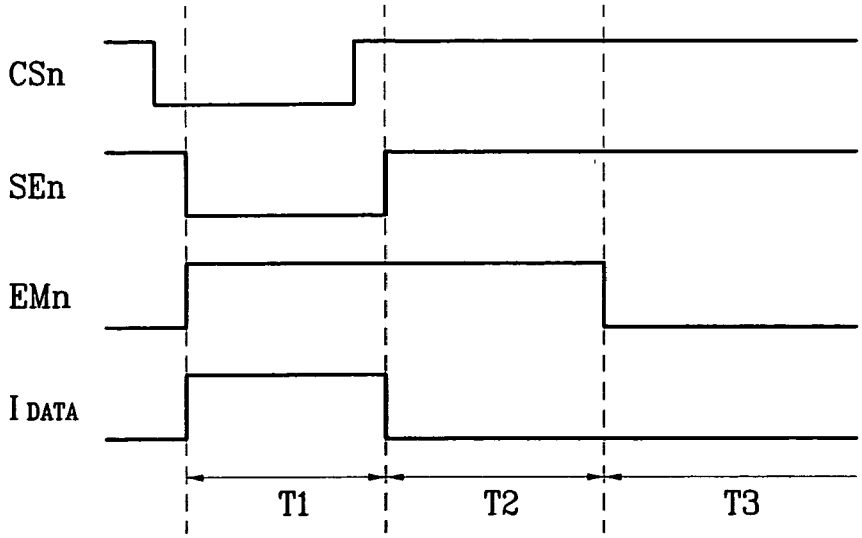

FIG. 7 shows an equivalent circuit of a pixel circuit according to a second embodiment of the present invention, and FIG. 8 shows a driving waveform for driving the pixel circuit of FIG. 7.

As shown in FIG. 7, the pixel circuit according to the second embodiment further includes scan line $C_n$ in the pixel circuit of FIG. 5. Transistor M5 has a gate coupled to scan line $C_n$, and couples the gate of transistor M1 to the gate of transistor M2 in response to control signal $CS_n$ from scan line $C_n$.

Referring to FIG. 8, since turn-on and turn-off timing problem of transistors M3 and M5 can occur in the first embodiment, control signal $CS_n$ is set to be low-level prior to select signal $SE_n$. In this instance, a delayed signal of control signal $CS_n$ can be used as a select signal $SE_n$.

In detail, transistor M5 is previously turned on by control signal $CS_n$ to couple the gate of transistor M1 and the gate of transistor M2, and transistor M3 is turned on by select signal $SE_n$ to transmit data current $I_{DATA}$. Transistor M5 is turned off by high-level control signal $CS_n$ to charge capacitors C1 and C2 with voltage, and transistor M3 is turned off by high-level select signal $SE_n$ to intercept data current $I_{DATA}$. Since the operation of the pixel circuit according to the second embodiment is similar to that of the first embodiment, no detailed description thereof will be provided.

According to the present invention, since the current flowing to the OLED can be controlled by a large data current, the data line can be sufficiently charged for a single line time, the deviation of the threshold voltage or the mobility is corrected, and a light emitting display with high resolution and wide screen can be realized.

While this invention has been described in connection with what is presently considered to be practical embodiments, it is to be understood that the invention is not limited to the disclosed embodiments, but, on the contrary, is intended to cover various modifications and equivalent arrangements included within the spirit and scope of the appended claims.

What is claimed is:

1. A light emitting display comprising:

a display panel on which are formed a plurality of data lines for transmitting data current that displays video signals, a plurality of scan lines for transmitting a select signal, and a plurality of pixel circuits formed at a plurality of pixels defined by the data lines and the scan lines, wherein at least one pixel circuit includes:

a light emitting element for emitting light corresponding to an applied current;

a first transistor, having a first main electrode, a second main electrode and a control electrode, for supplying a driving current for the light emitting element;

a second transistor being diode-connected;

a first switch for transmitting a data current from the data line to the second transistor in response to a select signal from the scan line;

a first storage element having a first end coupled to the first main electrode of the first transistor and a first main electrode of the second transistor, and a second end thereof coupled to the control electrode of the first transistor, the second end being coupled to a gate of the second transistor in response to a first level of a first control signal;

a second storage element coupled between the second end of the first storage element and a control electrode of the second transistor in response to a second level of the first control signal; and a second switch for coupling the first transistor and the light emitting element in response to a second control signal.

2. The light emitting display of claim 1, wherein the light emitting display operates in the order of: a first interval for selecting the first level of the first control signal and the select signal, a second interval for selecting the second level of the first control signal, and a third interval for selecting the second control signal.

3. The light emitting display of claim 2, wherein the voltage of the control electrode of the second transistor is determined as a first voltage in corresponding to the data current in the first interval;

a control electrode voltage of the second transistor is changed to a second voltage from the first voltage by the interception of the data current;

a control electrode voltage of the first transistor is determined as a third voltage by coupling of the first and second storage elements to store a fourth voltage in the first storage element in the second interval; and a driving current corresponding to the fourth voltage is transmitted to the light emitting element from the first transistor in the third interval.

4. The light emitting display of claim 1, wherein the pixel circuit further comprises a third switch coupled between the control electrodes of the first transistor and the second transistor; and the third switch is turned on by the first level of the first control signal.

5. The light emitting display of claim 1, wherein the first control signal is the select signal.

6. The light emitting display of claim 1, wherein the first control signal is supplied from an additional signal line other than the scan line, and the first control signal has faster timing than the select signal.

7. The light emitting display of claim 1, wherein a channel width of the first transistor is equal to or shorter than the channel width of the second transistor.

8. The light emitting display of claim 1, wherein a channel length of the first transistor is equal to or longer than the channel width of the second transistor.

9. The light emitting display of claim 1, wherein the first storage element is a first capacitor formed between the first main electrode and the control electrode of the first transistor;

the second storage element is a second capacitor formed between the control electrodes of the first transistor and the second transistor; and capacitance of the first capacitor and capacitance of the second capacitor is determined by one of a screen size and resolution.

10. The light emitting display of claim 1, wherein uniformity between the threshold voltages of the first transistor and the second transistor is high.

11. A method for driving a light emitting display having a pixel circuit including a first switch for transmitting a data current from a data line in response to a select signal from a scan line, a first transistor including a first main electrode, a second main electrode and a control electrode for outputting a driving current-corresponding to the data current, a first storage element formed between the first main electrode and the control electrode of the first transistor, and a light emitting element for emitting light corresponding to the driving current from the first transistor, the method comprising:

coupling the control electrode of the diode-connected second transistor to the control electrode of the first transistor;

transmitting the data current from the first switch to the second transistor to establish a control electrode voltage of the second transistor as a first voltage;

forming a second storage element between the control electrodes of the first transistor and the second transistor;

intercepting the data current to modify the first voltage into a second voltage to which a threshold voltage of the second transistor is reflected;

using coupling of the second voltage and the first storage element and second storage element to modify the control electrode voltage of the first transistor into a third voltage from the first voltage; and transmitting a driving current output by the first transistor to the light emitting element corresponding to the third voltage.

12. The method of claim 11, wherein the first main electrodes of the first transistor and the second transistor are coupled to a signal for supplying a power supply voltage.

13. The method of claim 11, wherein the threshold voltage of the first transistor substantially corresponds to the threshold voltage of the second transistor.

14. The method of claim 11, wherein the pixel circuit further includes a second switch coupled between the control electrodes of the first transistor and the second transistor, and the method further comprises:

turning on the second switch in response to an enable level of a control signal to couple the control electrodes of the first transistor and the second transistor; and turning off the second switch in response to a disable level of the control signal to couple the second storage element between the control electrodes of the first and second transistors.

15. The method of claim 14, wherein the control signal is the select signal.

16. The method of claim 11, wherein a ratio of a channel width and a channel length of the first transistor is equal to or less than a ratio of a channel width and a channel length of the second transistor.

17. The method of claim 11, wherein a ratio of capacitance of the first storage element and capacitance of the second storage element is determined according to one of a screen size and resolution.

18. A display panel of a light emitting display comprising:

a plurality of data lines for transmitting a data current that displays video signals;

a plurality of scan lines for transmitting a select signal;

a plurality of pixels defined by the data lines and the scan lines are formed; and a pixel circuit formed at each of the plurality of pixels;

wherein at least one pixel circuit includes:

a light emitting element for emitting light corresponding to an applied current thereto;

a first transistor having a first main electrode, a second main electrode and a control electrode, for supplying a driving current for emitting light from a light emitting element;

a second transistor being diode-connected;

a first switch for transmitting a data current from the data line to the second transistor in response to a select signal from the scan line;

a first storage element coupled to the control electrode of the first transistor; and a second storage element, and wherein the display panel operates in the order of:

a first interval for coupling control electrodes of the first transistor and the second transistor and storing voltage in the first storage element corresponding to a data current from the first switch, a second interval for forming a second storage element between the control electrodes of the first and second transistors, and intercepting the data current to divide a voltage corresponding to a threshold voltage of the second transistor into the first and second storage elements, and a third interval for transmitting a driving current output by the first transistor to the light emitting element, corresponding to the voltage stored in the first storage element.

19. The display panel of claim 18, wherein the control electrodes of the first transistor and the second transistor are coupled in response to a first-level first control signal;

data current is transmitted to the second transistor in response to the select signal in the first interval;

the second storage element is coupled between the control electrodes of the first transistor and the second transistor in response to a second-level first control signal;

the select signal becomes a disable level to intercept the data current in the second interval; and the driving current is transmitted to the light emitting element in response to a second control signal in the third interval.

20. The display panel of claim 19, wherein the first control signal is a select signal.

21. The display panel of claim 19, wherein the first control signal is a signal having faster timing than the timing of the select signal.

* * * * *

UNITED STATES PATENT AND TRADEMARK OFFICE

CERTIFICATE OF CORRECTION

PATENT NO. : 7,164,401 B2
APPLICATION NO. : 10/729505
DATED : January 16, 2007
INVENTOR(S) : Kwon It is certified that error appears in the above-identified patent and that said Letters Patent is hereby corrected as shown below:

On the Title Page

| | |
|---|---|
| (56) References Cited Other Publications | Insert --European Search Report for Application No. 03090384.3, dated August 25, 2004, in the name of Samsung SDI Co., Ltd. |
| (56) References Cited Other Publications A. Yumoto et al; "Pixel-Driving Methods for Large-Sized... | Delete "JApan", Insert --Japan-- |

In the Claims

| | |
|---|---|
| Column 10, line 12, Claim 9 | Delete "is", Insert --are-- |
| Column 10, line 22, Claim 11 | Delete "current-corrresponding", Insert --current corresponding-- |
| Column 11, line 14, Claim 18 | Delete "are formed" |

Signed and Sealed this

Eighteenth Day of September, 2007

JON W. DUDAS
*Director of the United States Patent and Trademark Office*